US008162698B2

(12) United States Patent
Johnson

(10) Patent No.: US 8,162,698 B2
(45) Date of Patent: Apr. 24, 2012

(54) VANDAL PROOF NMO ANTENNA MOUNT

(75) Inventor: Brandon Johnson, Bloomingdale, IL (US)

(73) Assignee: PC-Tel, Inc., Bloomingdale, IL (US)

( * ) Notice: Subject to any disclaimer, the term of this patent is extended or adjusted under 35 U.S.C. 154(b) by 34 days.

(21) Appl. No.: 12/874,737

(22) Filed: Sep. 2, 2010

(65) Prior Publication Data

US 2011/0053412 A1 Mar. 3, 2011

Related U.S. Application Data

(60) Provisional application No. 61/239,671, filed on Sep. 3, 2009.

(51) Int. Cl.
*H01R 33/20* (2006.01)

(52) U.S. Cl. ..... 439/675; 439/916

(58) Field of Classification Search ..... 439/578–585, 439/675, 916

See application file for complete search history.

(56) References Cited

U.S. PATENT DOCUMENTS

| | | | | |
|---|---|---|---|---|
| 4,790,774 | A * | 12/1988 | White | 439/551 |
| 4,957,456 | A * | 9/1990 | Olson et al. | 439/578 |
| 5,090,925 | A * | 2/1992 | Sato et al. | 439/862 |
| 7,014,502 | B2 * | 3/2006 | Rasmussen | 439/578 |
| 7,347,728 | B2 * | 3/2008 | Montena | 439/579 |

* cited by examiner

*Primary Examiner* — Khiem Nguyen
(74) *Attorney, Agent, or Firm* — Husch Blackwell LLP

(57) ABSTRACT

An antenna mount is provided including a contact pin having first and second distal ends, a barrel encasing the contact pin, a base encasing the barrel, a terminal lug press fit within a cross-section of the base, and a set screw receptacle disposed in a portion of the base for receiving a set screw to secure an antenna to the base. The first and second distal ends of the contact pin extend past first and second distal ends of the barrel, the first distal end of the contact pin extends past a first distal end of the base, and a second distal end of the base surrounds the second distal end of the pin.

20 Claims, 8 Drawing Sheets

VANDAL PROOF NMO ANTENNA MOUNT

CROSS-REFERENCE TO RELATED APPLICATIONS

This application claims priority to and hereby incorporates by reference U.S. Provisional Patent Application No. 61/239,671 filed Sep. 3, 2009 and titled "Vandal Proof NMO Antenna Mount."

FIELD OF INVENTION

The present invention relates generally to antenna mounts. More particularly, the present invention relates to vandal proof NMO antenna mounts.

BACKGROUND

Non-magnetic option ("NMO") antennas mounts are known in the art and are desirable because many standard antennas are designed and manufactured for compatibility with an NMO antenna mount. For example, FIGS. 1A, 1B, 1C, and 1D are perspective, top, bottom, and exploded views of an NMO antenna mount 100 known in the art. As best seen in FIG. 1D, the NMO antenna mount 100 can include a contact pin 110, a barrel 120, a base 130, and a terminal lug 140.

The contact pin 110 can be, for example, gold plated and include a first member 112 contiguous with and disposed adjacent to a second member 114. The first member 112 can include a laterally extending circular member disposed perpendicular to the second member 114, and the second member 114 can include an elongated shaft with first and second ends. The first end can be disposed adjacent to the first member 112, and the second end can include a notch 116.

The barrel 120 can be, for example, plastic and can include a first member 122 contiguous with and disposed adjacent to a second member 124. The first member 122 can include a laterally extending circular member disposed perpendicular to the second member 124, and the second member 124 can include an elongated shaft. A hollow center cylinder disposed within the first member 122 and the second member 124, and the shaft 114 of the pin 110 can fit into the hollow center cylinder of the barrel 120. As best seen in FIG. 1A, the notch 116 of the pin 110 can extend outside of the barrel 120. Similarly, as best seen in FIG. 1B, the first member 112 the pin 110 can extend outside of the barrel 120.

The base 130 can include a first member 132, and a second member 134 connected by a shaft 136. The first member 132 can include a laterally extending circular member disposed perpendicular to the second member 134, and the second member 134 can include a plate 134. A hollow center cylinder 138 disposed in the base 130 can extend through each of the first member 132, the second member 134, and the shaft 136, and the barrel 120 and pin 120 can fit into the cylinder 138. As best seen in FIG. 1A, the notch 116 of the pin 110 and the barrel 120 can extend outside of the second member 134 of the base 130. Similarly, as best seen in FIG. 1B, the first member 112 of the pin 110 and the barrel 120 can extend outside of the first member 132 of the base 130.

The terminal lug 140 can include a first member 142, and a second member 144. The first member 142 can include a washer 142 with an open center portion 146, and the second member 144 can include a channel extending outwardly from a peripheral edge of the first member 142. As best seen in FIG. 1C, the open center portion 146 of the first member 142 can be placed around at least a portion of the plate 134 of the base 130 and the pin 110 and barrel 120 that extends therefrom. The lug 140 can be soldered to a bottom side of the base 130 with solder 145 to secure the lug 140 thereto.

FIG. 1E is a bottom view of a coaxial cable 150 attached to the NMO antenna mount 100. At least a portion of the cable 150 can be stripped to expose the center conductor 152, and the center conductor 152 can be associated with the notch 116 of the pin 110 that extends outside of the barrel 120 and the base 130. Although not seen in FIG. 7B, the center conductor 152 of the cable 150 can be soldered to the pin 110 to secure the cable 150 thereto.

As best seen in FIG. 1A, an exterior circumference of the first member 132 of the base 130 can include threading 135 disposed thereon. An antenna can be attached to the mount 100 by screwing corresponding threading of the antenna onto the threading 135 of the mount 100. When attached to the mount 100 a push pin of the antenna can make contact with the first member 112 of the pin 110 that extends outside of the barrel 120 and the housing 130.

The above-described NMO antenna mount can be used in connection with an automobile, for example, a taxicab, and can be mounted on or in the body of the automobile so that the associated antenna is outside of the automobile. However, there is no protection against vandalism. Therefore, anyone with access to the antenna can simply unscrew the antenna from the mount without disassembling any portion of the antenna mount or the associated automobile.

Therefore, vandal proof antennas have been developed and are also known in the art. For example, FIGS. 2A, 2B, and 2C are perspective, top, and bottom views of a vandal proof antenna mount 200 known in the art. As best seen in FIG. 2A, the vandal proof antenna mount 200 can include a first member 210 contiguous with and disposed adjacent to a second member 220. Both of the exterior circumferences of the first member 210 and the second member 220 can include threading 215 and 225, respectively, disposed thereon.

The first member 210 can include laterally extending circular member disposed perpendicular to the second member 220. As best seen in FIG. 2B, the first member 210 can also include a hollow center cylinder 212 disposed therein, and the hollow center cylinder 212 can include a male connector 214 disposed therein. An antenna can be attached to the mount 200 by screwing corresponding threading of the antenna onto the threading 215 of the mount 200. When attached to the mount 200, a female connector of the antenna can engage the male connector 214 of the first member 210 of the mount 200.

The second member 220 of the antenna mount 200 can include an elongated shaft. As best seen in FIG. 2C, the second member 220 can also include a hollow center cylinder 222 disposed therein, and the hollow center cylinder 222 can include a male connector 224 disposed therein. As best seen in FIG. 2D, a bolt 242 associated with a coaxial cable 240 can be screwed onto the threading 225 of the mount 200. Thus, a female connector of the coaxial cable 240 can engage the male connector 224 of the second member 220 of the mount 200.

To protect against vandalism, the first member 210 of the antenna mount 200 can include a receptacle 230 for receiving a set screw. As best seen in FIG. 2A, the receptacle 230 can be disposed in a bottom side of the first member 210 and can include threading 232 along the length thereof. The receptacle 230 can bore through the first member 210 so that a screw placed in the receptacle 230 can extend from the receptacle on the bottom side of the first member 210 to and past an outside edge of the first member 210. After an antenna is attached to the mount 200 a set screw can be placed in the receptacle 230, and the set screw can be screwed into the antenna from the bottom side of the mount 200 to secure the antenna to the antenna mount 200.

Although vandal proof antenna mounts are desirable to protect against vandalism, these mounts present other disadvantages. For example, as seen in a comparison of FIG. 2A to FIG. 1A, the second member 220 of the vandal proof antenna mount 200 is significantly longer than any part of the NMO antenna mount 100. The length of the vandal proof antenna mount 200 thus limits the applications and environments in which these mounts can be used. For example, known vandal proof antenna mounts have traditionally been used in buses rather than automobiles because the size of these mounts has been incompatible with automobiles.

Additionally, as seen in FIGS. 2B, 2C, and 2D, the vandal proof antenna mount 200 includes non-standard interfaces. For example, the antenna interface of the first member 210 includes the male connector 214. However, the majority of antennas in the marketplace are not designed for such an interface. Further, the antenna interface of the second member 220 includes the male connector 224 and requires a female interface associated with a coaxial cable for connecting thereto as well as extra parts for connecting the female interface of the cable to the male interface of the mount. The extra parts add additional costs and height to the overall system, further limiting the applications and environments in which the mount can be used.

In view of the above, a single antenna mount that is vandal proof and compatible with a majority of antennas in the industry is desired. Preferably, a vandal proof NMO antenna mount in accordance with the present invention can include a standard interface for connecting to an antenna, at least one feature to protect against vandalism, and an interface for connecting a coaxial cable directly to a pin of the antenna mount.

SUMMARY OF THE INVENTION

According to one embodiment of the present invention, an antenna mount is provided. The antenna mount can include a contact pin having first and second distal ends, a barrel encasing the contact pin, the first and second distal ends of the contact pin extending past first and second distal ends of the barrel, a base encasing the barrel, the first distal end of the contact pin extending past a first distal end of the base, a second distal end of the base surrounding the second distal end of the pin, a terminal lug press fit within a cross-section of the base, and a set screw receptacle disposed in a portion of the base for receiving a set screw to secure an antenna to the base.

The contact pin can include gold plating, and the second distal end of the contact pin can include a notch.

At least a portion of the barrel can be made from a Teflon® polymer, and the contact pin, the barrel, and the base can maintain a 50 Ohm impedance.

Threading can be disposed on an exterior surface of at least a portion of the base, and the second distal end of the base can mechanically protect the second distal end of the pin.

The terminal lug can include a first member and a second member, and the second member of the terminal lug can laterally extend from a peripheral edge of the first member. The second member of the terminal lug can also laterally extend from a peripheral edge of the base. The second member can include a channel, and at least a portion of the terminal lug can be made from zinc.

The antenna mount can be adapted for connecting with an antenna, and the antenna can be attached to first distal end of the base. Threading disposed on at least a portion of an exterior circumference of the base can be adapted to be screwed into threading of the antenna, and a push pin of the antenna can contact the first distal end of the pin when the antenna is attached to the base.

The antenna mount can also be adapted for directly connecting with a coaxial cable. A center conductor of the coaxial cable can directly contact the second distal end of the pin when the coaxial cable connects with the antenna mount. The center conductor of the coaxial cable can be soldered to the second distal end of the pin, and a channel of the terminal lug supports at least a portion of the coaxial cable.

According to another embodiment of the present invention, an antenna mount is provided. The antenna mount can include a contact pin having first and second distal ends, a barrel encasing the contact pin, the first and second distal ends of the contact pin extending past first and second distal ends of the barrel, a base encasing the barrel, the first distal end of the contact pin extending past a first distal end of the base, a second distal end of the base surrounding the second distal end of the pin, and a terminal lug press fit within a cross-section of the base.

According to another embodiment of the present invention, an antenna mount is provided. The antenna mount can include a contact pin having first and second distal ends, a barrel encasing the contact pin, the first and second distal ends of the contact pin extending past first and second distal ends of the barrel, a base encasing the barrel, the first distal end of the contact pin extending past a first distal end of the base, a second distal end of the base surrounding the second distal end of the pin, a terminal lug press fit within a cross-section of the base, and a washer capable of threading onto at least a portion of the base for securing a gasket on the base, the washer including an open notch for accommodated the terminal lug.

DESCRIPTION OF THE PREFERRED EMBODIMENTS

Figure 1C:
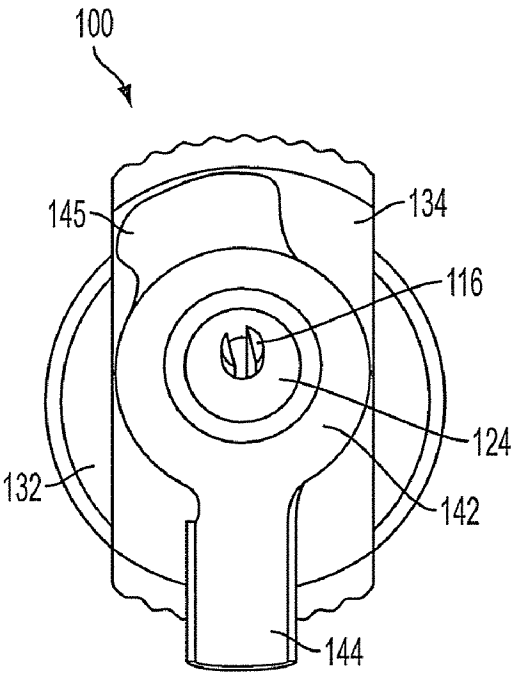
FIG. 1C PRIOR ART
FIG. 1C is a bottom view of an NMO antenna mount known in the art.
Figure 1B:
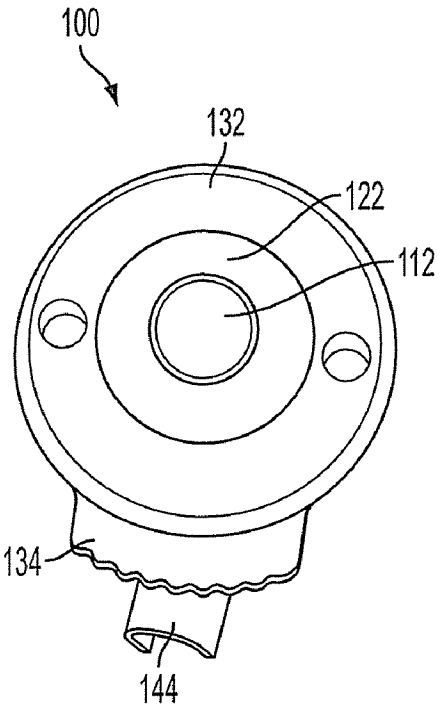
FIG. 1B PRIOR ART
FIG. 1B is a top view of an NMO antenna mount known in the art.
Figure 1A:
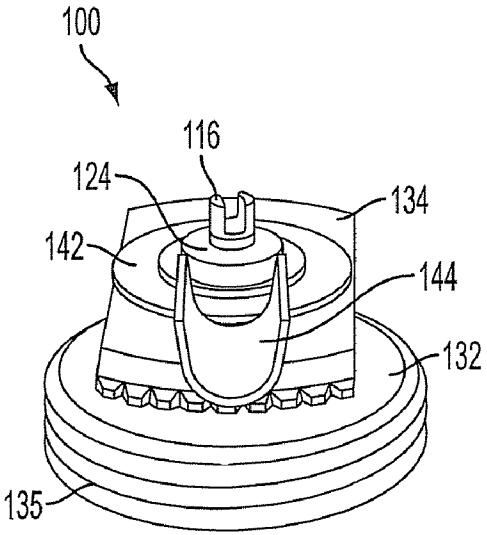
FIG. 1A PRIOR ART
FIG. 1A is a perspective view of an NMO antenna mount known in the art.
Figure 1D:
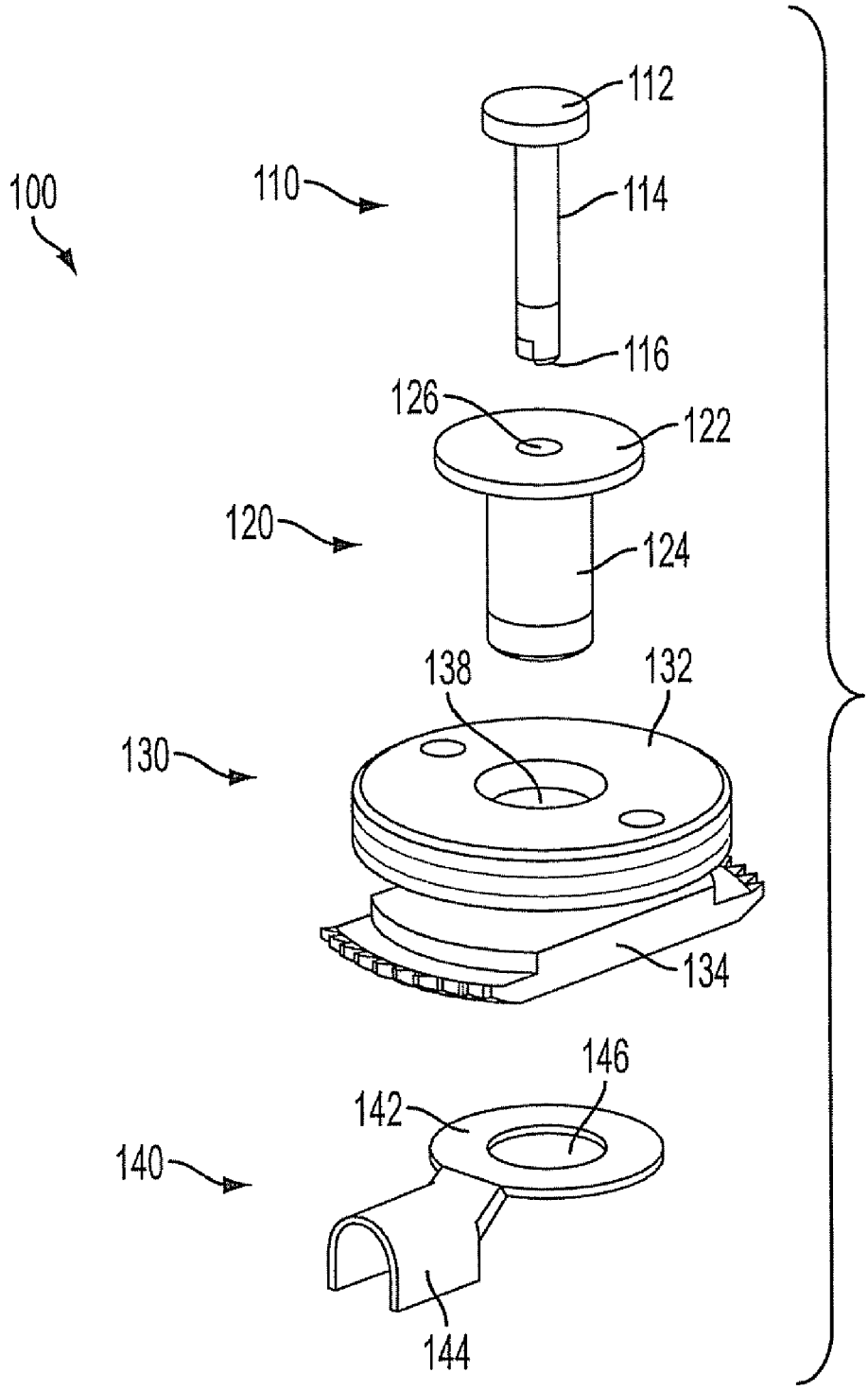
FIG. 1D PRIOR ART
FIG. 1D is an exploded view of an NMO antenna mount known in the art.
Figure 1E:
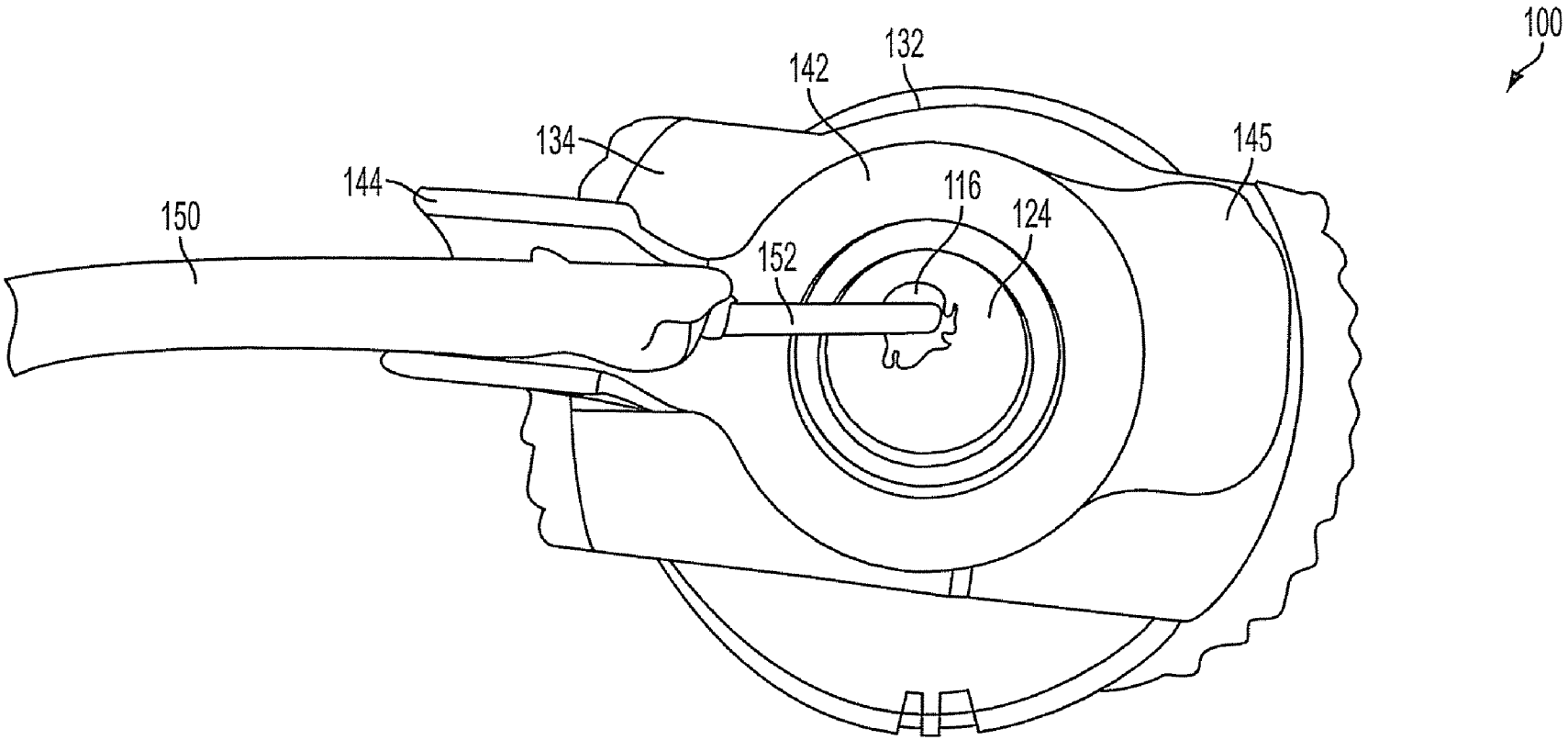
FIG. 1E PRIOR ART
FIG. 1E is a bottom view of a coaxial cable attached to an NMO antenna mount known in the art.
Figure 2C:
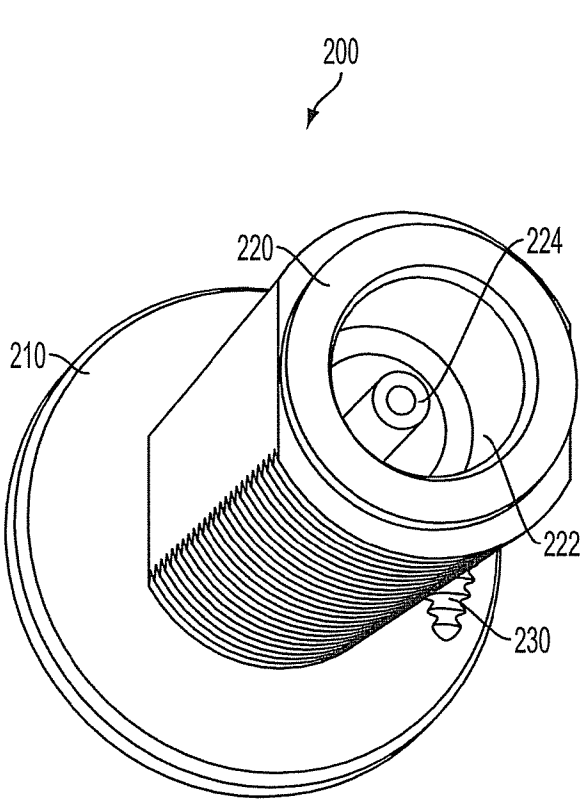
FIG. 2C PRIOR ART
FIG. 2C is a bottom view of a vandal proof antenna mount known in the art.
Figure 2B:
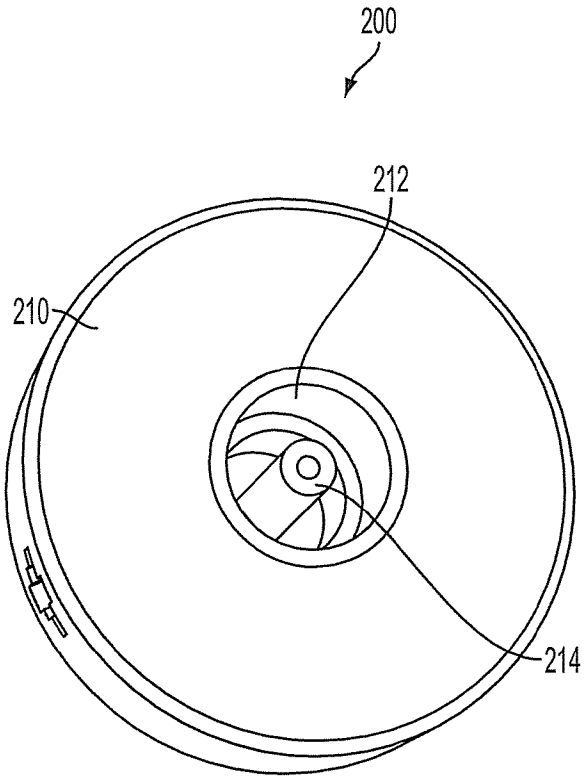
FIG. 2B PRIOR ART
FIG. 2B is a top view of a vandal proof antenna mount known in the art.
Figure 2A:
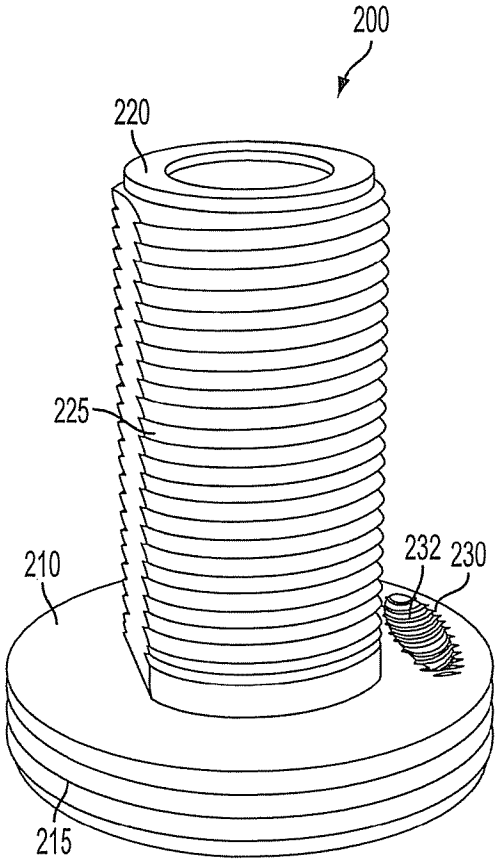
FIG. 2A PRIOR ART
FIG. 2A is a perspective view of a vandal proof antenna mount known in the art.
Figure 2D:
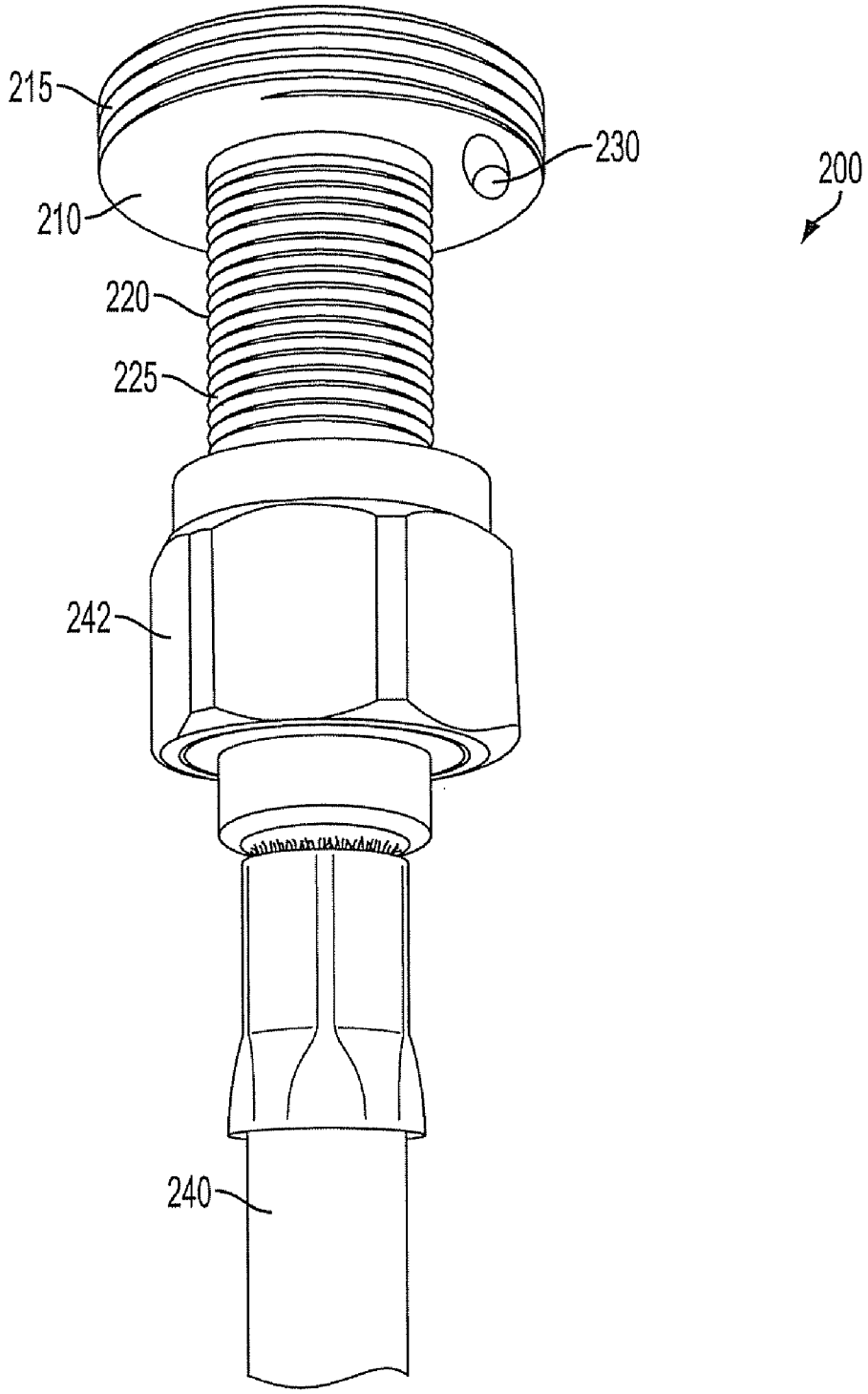
FIG. 2D PRIOR ART
FIG. 2D is a side view of a coaxial cable attached to a vandal proof antenna mount known in the art.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments of the present invention include a single antenna mount that is vandal proof and compatible with a majority of antennas in the industry. For example, a vandal proof NMO antenna mount in accordance with the present invention can include a standard interface for connecting to an antenna, at least one feature to protect against vandalism, and an interface for connecting a coaxial cable directly to a pin of the antenna mount.

Figure 3C:
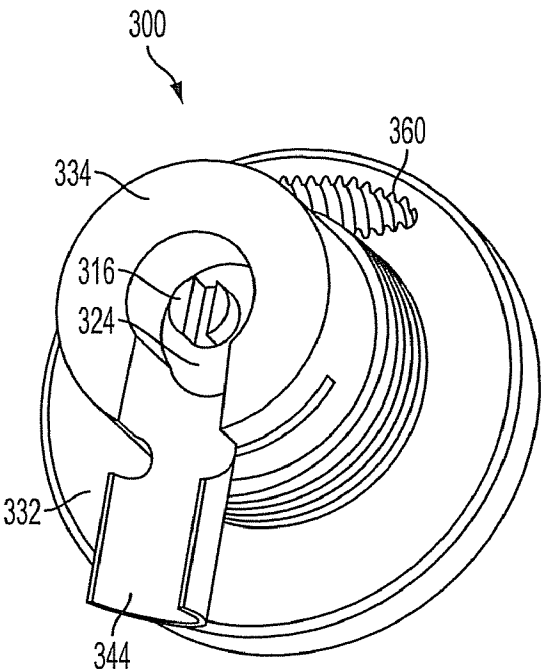
FIG. 3C is a bottom view of a vandal proof NMO antenna mount in accordance with the present invention.
Figure 3B:
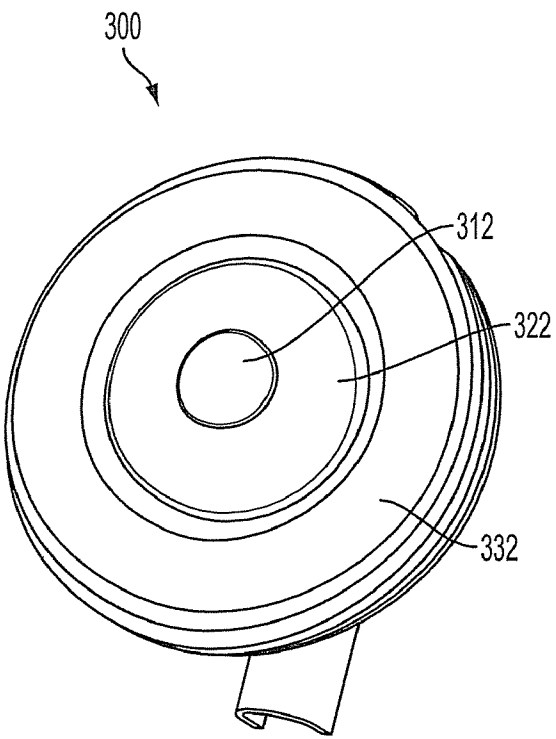
FIG. 3B is a top view of a vandal proof NMO antenna mount in accordance with the present invention.
Figure 3A:
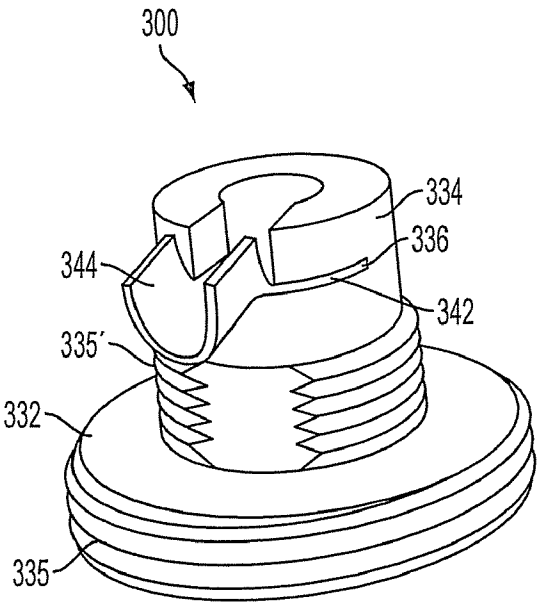
FIG. 3A is a perspective view a vandal proof NMO antenna mount in accordance with the present invention.

FIGS. 3A, 3B, and 3C are perspective, top, and bottom views of a vandal proof antenna mount in accordance with the present invention. The vandal proof NMO antenna mount 300 in accordance with the present invention can include a contact pin 310, a barrel 320, a base 330, and a terminal lug 340.

The contact pin 310 can be, for example, gold plated and include a first member 312 contiguous with and adjacent to a second member 314. The first member 312 can include a laterally extending circular member disposed perpendicular to the second member, and the second member 314 can include an elongated shaft with first and second ends. The first end can be disposed adjacent to the first member 312, and the second member can include a notch 316.

The barrel 320 can be, for example, plastic, and can include a first member 322 disposed adjacent to a second member 324. The first member 322 can include a laterally extending circular member disposed perpendicular to the second member 324, a hollow center cylinder can be disposed within the first member 322 and the second member 324. The pin 310 can fit into the hollow center cylinder of the barrel 3210 so that the notch 316 of the pin extends outside of the barrel, and the first member 310 of the pin 310 extends outside of the barrel 320.

In embodiments of the present invention, the barrel 320 can be formed at least in part from a Teflon® polymer. Teflon® polymers can be preferable to, for example, Delrin® polymers, because Teflon® polymers minimize electrical loss. In embodiments of the present invention, it is desirable to maintain a 50 Ohm impedance.

The base 330 can include a first member 332 contiguous and adjacent to a second member 334. The first member 332 can include a laterally extending circular member disposed perpendicular to the second member 334, and the second member 334 can include an elongated shaft. In embodiments of the present invention, the second member 334 can be approximately half the length of the second member 220 of a vandal proof antenna known in the art.

A hollow center cylinder can be disposed within the first member 332 and the second member 334, and the pin 110 and barrel 120 can be fit therein. As best seen in FIG. 3B, the first member 322 can extend outside of the barrel 320 and the base 330. As best seen in FIG. 3C, the notch 316 of the pin 310 can extend outside of the barrel 320, yet be surrounded by a distal end of the second member 334 of the base 330. Thus, the second member 334 of the base 330 can mechanically protect the notch 316 extending from the barrel 320.

As compared to NMO antenna mounts known in the art, the notch 316 of the pin 310 can sit lower than the distal end of the base 330 so that the pin 310 is fully surrounded by the base 330. The arrangement of the pin 310 relative to the base 330 in a vandal proof NMO antenna mount in accordance with the present invention provides for less impedance mismatch. As explained above, a 50 Ohm impedance is preferred.

The terminal lug 340 can include a first member 342 contiguous with a second member 344. The first member 342 can include washer with an open center portion, and the second member 344 can include a channel extending outwardly from a peripheral edge of the first member 342. In embodiments of the present invention, the second member can be formed at least in part from zinc.

As best seen in FIGS. 3A and 3C, a lateral slot 336 can be disposed within a cross-section of the second member 334 of the base 330, and the first member 342 of the terminal lug 340 can be press fit into the slot 336. Accordingly, the second member 344 of the terminal lug 340 can extend outwardly from a peripheral edge of the first member 334 of the base 330.

Figure 3D:
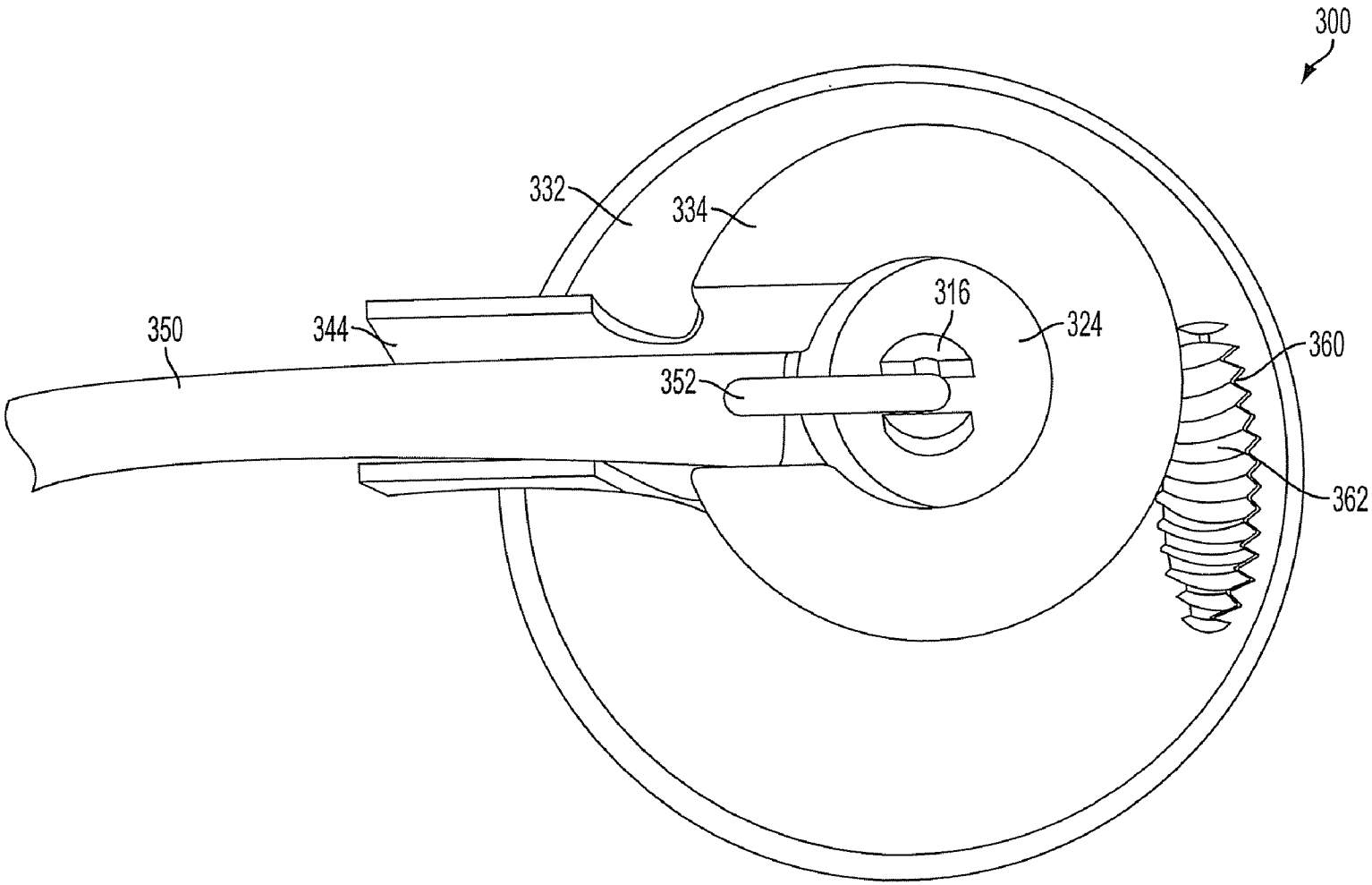
FIG. 3D is a bottom view of a coaxial cable attached to a vandal proof NMO antenna mount in accordance with the present invention.

FIG. 3D is a bottom view of a coaxial cable 350 attached to the vandal proof NMO antenna mount 300 in accordance with the present invention. As seen in FIG. 3D, the second member 344 of the terminal lug 340 can support the cable 350 leading to the pin 310, and the cable 350 can connect directly to the antenna mount 300. At least a portion of the cable 350 can be stripped to expose the center conductor 352, and the center conductor 352 can be connected directly to the notch 316 of the pin 310 that extends outside of the barrel 320, but not the base 330. Solder can be used to secure the center conductor 352 of the cable 350 to the notch 316 of the pin 310.

The exterior circumference of the first member 332 of the base 330 can include threading 335 disposed thereon. Similarly, at least a portion of the exterior circumference of the second member 334 of the base 330 can include threading 335' disposed thereon. An antenna can be attached to the mount 300 in accordance with the present invention by screwing corresponding threading of the antenna onto the threading 335 of the mount 300. When attached to the mount 300 a push pin of the antenna can make contact with the first member 312 of the pin 310 that extends outside of the barrel 320 and the housing 330.

To protect against vandalism, the first member 332 of the base 330 can include a receptacle 360 for receiving a set screw. As best seen in FIG. 3D, the receptacle 360 can be disposed in a bottom side of the first member 332 of the base and can include threading 362 along the length thereof. The receptacle 360 can bore through the first member 332 of the base 330 so that a screw placed in the receptacle 360 can extend from the receptacle 360 on the bottom side of the first member 332 of the base 330 to and past an outside edge of the base 330. After an antenna is attached to the mount 300 a set screw can be placed in the receptacle 360, and the set screw can be screwed into the antenna from the bottom side of the mount 300 to secure the antenna to the antenna mount 300.

Figure 4:
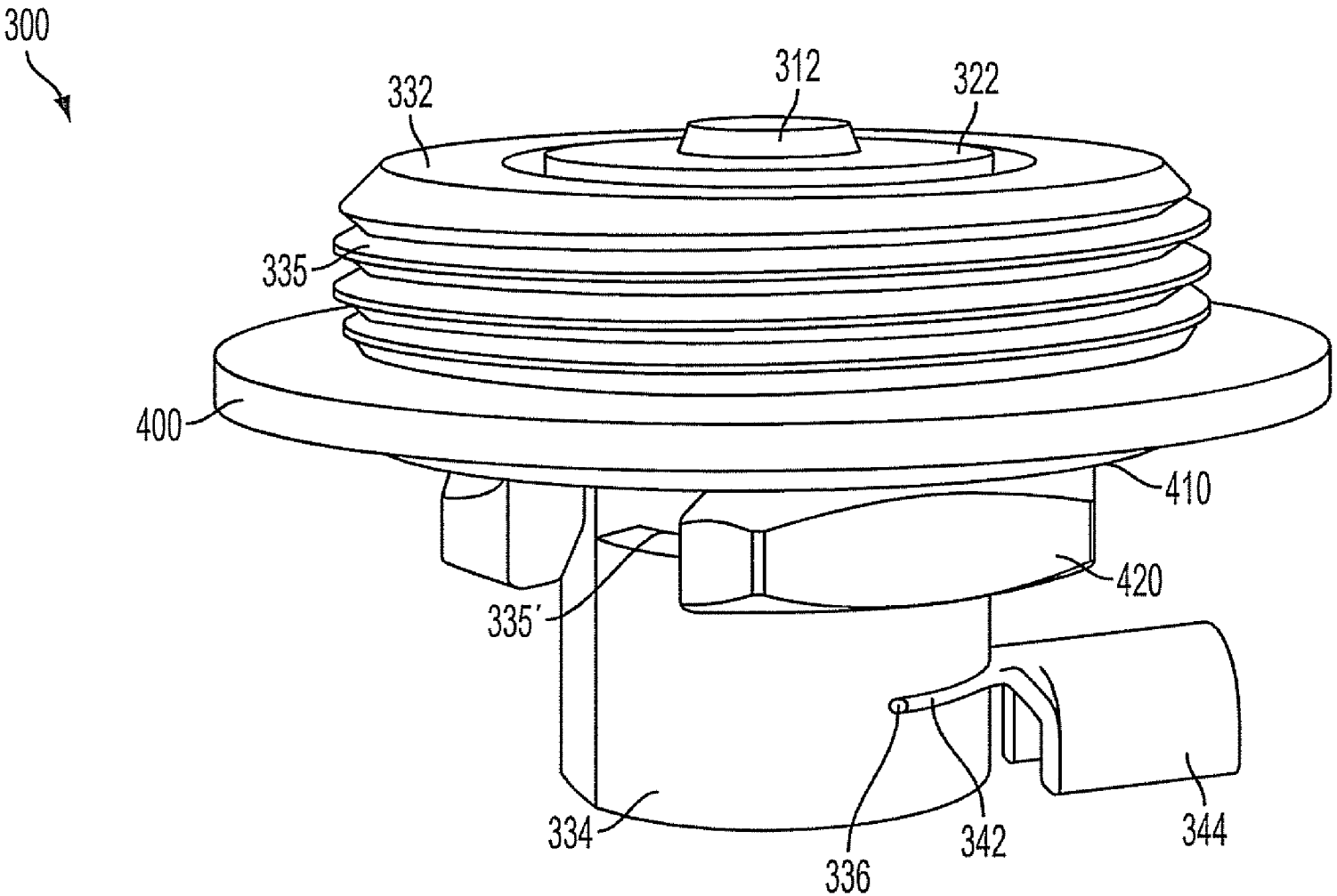
FIG. 4 is a side view of a sealing gasket associated with a vandal proof NMO antenna mount in accordance with the present invention.

FIG. 4 is a side view of a sealing gasket 400 associated with the vandal proof NMO antenna mount 300 in accordance with the present invention. As seen in FIG. 4, a gasket 400 and washer 420 can be threaded onto the second member 334 of the base 330 with the threading 335'. The gasket 400 can aid in water and weather proofing the environment in which the antenna mount 300 is located.

To secure the gasket 400 and washer 420 in place, a notched bolt 420 can be screwed onto the second member 334 of the base. As seen in FIG. 4, the bolt 420 can be circular with a hollow center. To accommodate the second member 344 of the terminal lug 340, the bolt 420 can also include an open notch disposed along the circumference of the bolt 420.

As shown and described above, the vandal proof NMO antenna mount according to the present invention includes a standard interface for connecting with a majority of antennas in the marketplace. Furthermore, the vandal proof NMO antenna mount in accordance with the present invention includes an interface for connecting directly with a coaxial cable without additional parts, other than solder, to make the connection.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An antenna mount comprising:

a contact pin having first and second distal ends;

a barrel encasing the contact pin, the first and second distal ends of the contact pin extending past first and second distal ends of the barrel;

a base encasing the barrel, the first distal end of the contact pin extending past a first distal end of the base, a second distal end of the base surrounding the second distal end of the pin;

a terminal lug press fit within a cross-section of the base; and a set screw receptacle disposed in a portion of the base for receiving a set screw to secure an antenna to the base.

2. The antenna mount of claim 1 wherein the contact pin includes gold plating.

3. The antenna mount of claim 1 wherein the second distal end of the contact pin includes a notch.

4. The antenna, mount of claim 1 wherein at least a portion of the barrel is made from a Teflon® polymer.

5. The antenna mount of claim 1, wherein the contact pin, the barrel, and the base maintain a 50 Ohm impedance.

6. The antenna mount of claim 1 further comprising threading disposed on an exterior circumference of at least a portion of the base.

7. The antenna mount of claim 1 wherein the second distal end of the base mechanically protects the second distal end of the pin.

8. The antenna mount of claim 1 wherein the terminal lug includes a first member and a second member, the second member of the terminal lug laterally extending from a peripheral edge of the first member.

9. The antenna mount of claim 8 wherein the second member of the terminal lug laterally extends from a peripheral edge of the base.

10. The antenna mount of claim 8 wherein the second member includes a channel.

11. The antenna mount of claim 1 wherein at least a portion of the terminal lug is made from zinc.

12. The antenna mount of claim 1 adapted for connecting with an antenna.

13. The antenna mount of claim 12 wherein the antenna is attached to first distal end of the base.

14. The antenna mount of claim 13 wherein threading disposed on at least a portion of an exterior circumference of the base is adapted to be screwed into threading of the antenna.

15. The antenna mount of claim 13 wherein a push pin of the antenna contacts the first distal end of the pin when the antenna is attached to the base.

16. The antenna mount of claim 1 adapted for directly connecting with a coaxial cable.

17. The antenna mount of claim 16 wherein a center conductor of the coaxial cable directly contacts the second distal end of the pin when the coaxial cable connects with the antenna mount.

18. The antenna mount of 17 wherein the center conductor of the coaxial cable is soldered to the second distal end of the pin.

19. The antenna mount of claim 17 wherein a channel of the terminal lug supports at least a portion of the coaxial cable.

20. An antenna mount comprising:

a contact pin having first and second distal ends;

a barrel encasing the contact pin, the first and second distal ends of the contact pin extending past first and second distal ends of the barrel;

a base encasing the barrel, the first distal end of the contact pin extending past a first distal end of the base, a second distal end of the base surrounding the second distal end of the pin; and a terminal lug press fit within a cross-section of the base.

* * * * *